US008394566B2

(12) United States Patent
Kmiecik-Lawrynowicz et al.

(10) Patent No.: US 8,394,566 B2
(45) Date of Patent: Mar. 12, 2013

(54) NON-MAGNETIC SINGLE COMPONENT EMULSION/AGGREGATION TONER COMPOSITION

(75) Inventors: Grazyna E. Kmiecik-Lawrynowicz, Fairport, NY (US); Maura A. Sweeney, Irondequoit, NY (US); Daniel W. Asarese, Honeoye Falls, NY (US); Samir Kumar, Pittsford, NY (US); Juan A. Morales-Tirado, West Henrietta, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 43 days.

(21) Appl. No.: 12/954,281

(22) Filed: Nov. 24, 2010

(65) Prior Publication Data

US 2012/0129088 A1 May 24, 2012

(51) Int. Cl.
*G03G 9/08* (2006.01)
*C08J 3/20* (2006.01)

(52) U.S. Cl. ..... 430/108.2; 430/108.6; 430/137.14

(58) Field of Classification Search ..... 430/108.1, 430/108.2, 108.7
See application file for complete search history.

(56) References Cited

U.S. PATENT DOCUMENTS

| | | | | |
|---|---|---|---|---|
| 2,874,063 | A | 2/1959 | Greig | |
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,983,045 | A | 9/1976 | Jugle et al. | |
| 4,265,990 | A | 5/1981 | Stolka et al. | |
| 4,298,672 | A | 11/1981 | Lu | |
| 4,338,390 | A | 7/1982 | Lu | |
| 4,563,408 | A | 1/1986 | Lin et al. | |
| 4,584,253 | A | 4/1986 | Lin et al. | |
| 4,585,884 | A | 4/1986 | Lin et al. | |
| 5,278,020 | A | 1/1994 | Grushkin et al. | |
| 5,290,654 | A | 3/1994 | Sacripante et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,348,832 | A | 9/1994 | Sacripante et al. | |
| 5,364,729 | A | 11/1994 | Kmiecik-Lawrynowicz et al. | |
| 5,366,841 | A | 11/1994 | Patel et al. | |
| 5,370,963 | A | 12/1994 | Patel et al. | |
| 5,403,693 | A | 4/1995 | Patel et al. | |
| 5,405,728 | A | 4/1995 | Hopper et al. | |
| 5,418,108 | A | 5/1995 | Kmiecik-Lawrynowicz et al. | |
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,943 | A | 12/1998 | Cheng et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 6,004,714 | A | 12/1999 | Ciccarelli et al. | |
| 6,190,815 | B1 | 2/2001 | Ciccarelli et al. | |
| 6,566,025 | B1 * | 5/2003 | McStravick et al. | 430/108.11 |
| 6,576,389 | B2 | 6/2003 | Vanbesien et al. | |
| 6,610,452 | B2 * | 8/2003 | Combes et al. | 430/108.11 |
| 6,617,092 | B1 | 9/2003 | Patel et al. | |
| 6,627,373 | B1 | 9/2003 | Patel et al. | |
| 6,638,677 | B2 | 10/2003 | Patel et al. | |
| 6,656,657 | B2 | 12/2003 | Patel et al. | |
| 6,656,658 | B2 | 12/2003 | Patel et al. | |
| 6,664,017 | B1 | 12/2003 | Patel et al. | |
| 6,673,505 | B2 | 1/2004 | Jiang et al. | |
| 6,730,450 | B1 | 5/2004 | Moffat et al. | |
| 6,743,559 | B2 | 6/2004 | Combes et al. | |
| 6,756,176 | B2 | 6/2004 | Stegamat et al. | |
| 6,780,500 | B2 | 8/2004 | Dumouchel | |
| 6,830,860 | B2 | 12/2004 | Sacripante et al. | |
| 7,029,817 | B2 | 4/2006 | Robinson et al. | |
| 7,402,370 | B2 | 7/2008 | Kmiecik-Lawrynowicz et al. | |
| 7,704,662 | B2 | 4/2010 | Kmiecik-Lawrynowicz et al. | |
| 7,704,665 | B2 | 4/2010 | Kmiecik-Lawrynowicz et al. | |
| 2005/0250030 | A1 * | 11/2005 | McStravick et al. | 430/108.6 |
| 2006/0003244 | A1 * | 1/2006 | Grande et al. | 430/106.2 |
| 2007/0087280 | A1 * | 4/2007 | Patel et al. | 430/110.2 |
| 2008/0107989 | A1 | 5/2008 | Sacripante et al. | |
| 2008/0153027 | A1 * | 6/2008 | Veregin et al. | 430/113 |
| 2008/0247788 | A1 * | 10/2008 | Ayaki et al. | 399/321 |

FOREIGN PATENT DOCUMENTS

| | | |
|---|---|---|
| GB | 1442835 | 7/1976 |

OTHER PUBLICATIONS

U.S. Appl. No. 12/575,718, filed Oct. 8, 2009.
U.S. Appl. No. 12/954,332, filed Nov. 24, 2010.

* cited by examiner

*Primary Examiner* — Jonathan Jelsma
(74) *Attorney, Agent, or Firm* — Oliff & Berridge, PLC

(57) ABSTRACT

A toner composition with a novel surface additive package for developing images. The additive package includes sol-gel silica, a PDMS silica, an organic spacer such as PMMA and HMDS silica. The toner composition exhibits improved control of voltage, higher print density, lower toner amount remaining on the roll, lower toner usage, and reduced drum contamination. The toner composition also exhibits improved dry theological properties. These improved properties make this toner composition useful for higher speed printing while using less toner.

26 Claims, No Drawings

NON-MAGNETIC SINGLE COMPONENT EMULSION/AGGREGATION TONER COMPOSITION

TECHNICAL FIELD

This disclosure is generally directed to toner compositions, and methods for producing such toners, for use in forming and developing images of good quality. More specifically, this disclosure is directed to toner compositions containing a novel toner particle formulation and novel surface additive package, and methods for producing such compositions. Such compositions are useful, for example, as toners in single component development (SCD) systems.

BACKGROUND

Emulsion aggregation (EA) toners are used in forming print and/or xerographic images. Emulsion aggregation techniques typically involve the formation of an emulsion latex of resin particles that have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally with additional resin, is separately formed. The colorant dispersion is added to the emulsion latex mixture, and an aggregating agent or complexing agent is then added and/or aggregation is otherwise initiated to form aggregated toner particles. The aggregated toner particles are heated to enable coalescence/fusing, thereby achieving aggregated, fused toner particles. United States patent documents describing emulsion aggregation toners include, for example, U.S. Pat. Nos. 5,278,020; 5,290,654; 5,308,734; 5,344,738; 5,346,797; 5,348,832; 5,364,729; 5,366,841; 5,370,963; 5,403,693; 5,405,728; 5,418,108; 5,496,676; 5,501,935; 5,527,658; 5,585,215; 5,650,255; 5,650,256; 5,723,253; 5,744,520; 5,747,215; 5,763,133; 5,766,818; 5,804,349; 5,827,633; 5,840,462; 5,853,943; 5,853,944; 5,863,698; 5,869,215; 5,902,710; 5,910,387; 5,916,725; 5,919,595; 5,925,488; 5,977,210; 6,576,389; 6,617,092; 6,627,373; 6,638,677; 6,656,657; 6,656,658; 6,664,017; 6,673,505; 6,730,450; 6,743,559; 6,756,176; 6,780,500; 6,830,860; and 7,029,817; and U.S. Patent Application Publication No. 2008/0107989.

The disclosures of each of the foregoing patents and publications are hereby incorporated by reference herein in their entireties. The appropriate components and process aspects of each of the foregoing patents and publications may also be selected for the present compositions and processes in embodiments thereof.

Current formulations of toner show a need for improved fusing performance. Poor fusing creates problems in paper adhesion and print performance.

Current formulations of toner show a need for improved flow. Poor flow creates problems in gravity-fed cartridges, causing toner to hang up due to poor flow properties and leads to deletions on paper.

There remains a need for an improved toner composition and process that overcomes or alleviates the above-described and other problems. There further remains a need for a toner composition suitable for high speed printing, particularly high speed monochrome printing that can provide excellent flow, charging, lower toner usage, and reduced drum contamination.

SUMMARY

This disclosure addresses some or all of the above problems, and others, by providing new toner compositions including a novel additive package. This disclosure thus relates to toners, developers containing toners, and devices for generating developed images with, for example, high print quality.

Herein is disclosed a toner composition comprising toner particles that comprise a resin, an optional wax, and an optional colorant; and a surface additive at least partially coating toner particle surfaces. The surface additive comprises a mixture of: a hexamethyldisilazane (HMDS) surface treated silica, a sol-gel silica that is not surface treated, and an optional polydimethylsiloxane (PDMS) surface treated silica.

Also disclosed is a method of making a toner composition by forming a slurry by mixing together an emulsion containing a resin, optionally a wax, optionally a colorant, optionally a surfactant, optionally a coagulant, and one or more additional optional additives; heating the slurry to form aggregated particles in the slurry; freezing aggregation of the particles by adjusting the pH; heating the aggregated particles in the slurry to coalesce the particles into toner particles; recovering the toner particles; and coating the toner particles with a surface additive comprising a mixture of: a hexamethyldisilazane (HMDS) surface treated silica, a sol-gel silica that is not surface treated, and an optional polydimethylsiloxane (PDMS) surface treated silica.

EMBODIMENTS

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

For single component developers, i.e. developers that contain no charge carriers as in two component developers, it is important for the toner particles to exhibit high transfer efficiency, including excellent flow properties and functional cohesivity. The toners described herein as embodiments have appropriate compositions and physical properties to be suited for use in single component developer machines. These compositions and properties will be detailed below.

A toner is provided that comprises at least a binder, an optional wax, an optional colorant, and a surface additive package. The additive package is used to coat external surfaces of toner particles. That is, the toner particles are first formed, followed by mixing of the toner particles with the materials of the additive package. The result is that the additive package generally coats or adheres to external surfaces of the toner particles, rather than being incorporated into the bulk of the toner particles.

Suitable toner compositions, which may be modified to include the external additive package of the present disclosure, include those toner compositions and particles disclosed in, for example, co-pending U.S. patent application Ser. No. 12/575,718, filed on Oct. 8, 2009, the entire disclosure of which is incorporated herein by reference.

Resins and Polymers

Any monomer suitable for preparing a latex for use in a toner may be used. As noted above, the toner may be produced by emulsion aggregation. Suitable monomers useful in forming a latex polymer emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like.

As the toner (or binder) resin, any of the conventional toner resins can be used. Illustrative examples of suitable toner resins include, for example, thermoplastic resins such as vinyl resins in general or styrene resins in particular, and polyesters. Examples of suitable thermoplastic resins include styrene methacrylate; polyolefins; styrene acrylates, such as PSB-2700 obtained from Hercules-Sanyo Inc.; styrene butadienes; crosslinked styrene polymers; epoxies; polyurethanes; vinyl resins, including homopolymers or copolymers of two or more vinyl monomers; and polymeric esterification products of a dicarboxylic acid and a dial comprising a diphenol. Other suitable vinyl monomers include styrene; p-chlorostyrene unsaturated mono-olefins such as ethylene, propylene, butylene, isobutylene, and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile; methacrylonitrile; acrylamide; mixtures thereof; and the like. In addition, crosslinked resins, including polymers, copolymers, and homopolymers of styrene polymers, may be selected.

The latex polymer may include at least one polymer. Exemplary polymers include styrene acrylates, styrene butadienes, styrene methacrylates, and more specifically, poly (styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), polystyrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), polyacrylonitrile-butyl acrylate-acrylic acid), and combinations thereof. The polymers may be block, random, or alternating copolymers.

A poly(styrene-butyl acrylate) may be used as the latex polymer. The glass transition temperature of this latex may be from about 35° C. to about 75° C., such as from about 40° C. to about 70° C.

The molecular weight may be measured by mixed bed gel permeation chromatography.

Waxes

In addition to the polymer binder resin, the toners may also contain a wax, either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

The wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of the toner, such as from about 3 to about 15 wt % of the toner, on a dry basis; or from about 5 to about 20 wt % of the toner, or from about 5 to about 12 wt % of the toner.

In some embodiments, the wax is a paraffin wax. Suitable paraffin waxes include paraffin waxes possessing modified crystalline structures, which may be referred to herein as modified paraffin waxes. Compared with conventional paraffin waxes, which may have a symmetrical distribution of linear carbons and branched carbons, the modified paraffin waxes may possess branched carbons in an amount of from about 1 to about 20 wt % of the wax, such as from about 8 to about 16 wt % of the wax, with linear carbons present in an in amount of from about 80 to about 99 wt % of the wax, or from about 84 to about 92 wt % of the wax.

In addition, the isomers, i.e., branched carbons, present in such modified paraffin waxes may have a number average molecular weight (Mn), of from about 520 to about 600, such as from about 550 to about 570, or about 560. The linear carbons, sometimes referred to herein as normals, present in such waxes may have a Mn of from about 505 to about 530, such as from about 512 to about 525, or about 518. The weight average molecular weight (Mw) of the branched carbons in the modified paraffin waxes may be from about 530 to about 580, such as from about 555 to about 575, and the Mw of the linear carbons in the modified paraffin waxes may be from about 480 to about 550, such as from about 515 to about 535.

For the branched carbons, the weight average molecular weight (Mw) of the modified paraffin waxes may demonstrate a number of carbon atoms of from about 31 to about 59 carbon atoms, such as from about 34 to about 50 carbon atoms, with a peak at about 41 carbon atoms, and for the linear carbons, the Mw may demonstrate a number of carbon atoms of from about 24 to about 54 carbon atoms, or from about 30 to about 50 carbon atoms, with a peak at about 36 carbon atoms.

The modified paraffin wax may be present in an amount of from about 2 wt % to about 20 wt % by weight of the toner, such as from about from about 4 wt % to about 15 wt % by weight of the toner, or from about 5 wt % to about 13 wt % by weight of the toner.

Colorants

The toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta EO2 that may be dispersed in water and/or surfactant prior to use.

Other colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foran Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %. However, amounts outside these ranges can also be used.

Coagulants

Coagulants used in emulsion aggregation processes for making toners include monovalent metal coagulants, divalent metal coagulants, polyion coagulants, and the like. As used herein, "polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds may have from about 2 to about 13, such as from about 3 to about 8, aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt % of the toner particles.

Surfactants

Colorants, waxes, and other additives used to form toner compositions may be in dispersions that include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt % weight of the toner composition, or from about 1 to about 3 wt % of the toner composition.

Examples of suitable nonionic surfactants include, for example, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWFAX™2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Initiators

Initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be used include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators may be added in suitable amounts, such as from about 0.1 to about 8 wt % of the monomers, or from about 0.2 to about 5 wt % of the monomers.

Chain Transfer Agents

Chain transfer agents may also be used in forming the latex polymer. Suitable chain transfer agents include dodecane thiol, octane thiol, carbon tetrabromide, combinations thereof, and the like, in amounts from about 0.1 to about 10 wt %, such as from about 0.2 to about 5 wt % of monomers, to control the molecular weight properties of the latex polymer when emulsion polymerization is conducted in accordance with the present disclosure.

Secondary Latex

A secondary latex may be added to the non-crosslinked latex resin suspended in the surfactant. As used herein a secondary latex may refer to a crosslinked resin or polymer, or mixtures thereof, or a non-crosslinked resin as described above, that has been subjected to crosslinking.

The secondary latex may include submicron crosslinked resin particles having a size of from about 10 to about 200 nanometers in volume average diameter, such as from about 20 to 100 nanometers. The secondary latex may be suspended in an aqueous phase of water containing a surfactant, where the surfactant is present in an amount of from about 0.5 to about 5 wt % of total solids, such as from about 0.7 to about 2 wt % of total solids.

The crosslinked resin may be a crosslinked polymer such as crosslinked poly-styrene acrylates, poly-styrene butadienes, and/or poly-styrene methacrylates. Exemplary crosslinked resins include crosslinked polystyrene-alkyl acrylate), poly(styrene-butadiene), poly(styrene-isoprene), poly(styrene-alkyl methacrylate), poly(styrene-alkyl acrylate-acrylic acid), poly(styrene-butadiene-acrylic acid), poly (styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly(alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 to about 25 wt % of the crosslinked resin, such as from about 0.5 to about 15 wt % of the crosslinked resin.

The crosslinked resin particles may be present in an amount of from about 1 to about 20 wt % of the toner, such as from about 4 to about 15 percent by wt %, or from about 5 to about 14 wt % of the toner.

The resin used to form the toner may be a mixture of a gel resin and a non-crosslinked resin.

Functional Monomers

A functional monomer may be included when forming a latex polymer and the particles making up the polymer. Suitable functional monomers include monomers having carboxylic acid functionality. Such functional monomers may be of the following formula (I):

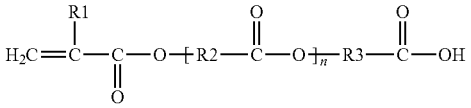

(I)

where R1 is hydrogen or a methyl group; R2 and R3 are independently selected from alkyl groups containing from about 1 to about 12 carbon atoms or a phenyl group; n is from about 0 to about 20, such as from about 1 to about 10. Examples of such functional monomers include beta carboxyethyl acrylate (β-CEA), poly(2-carboxyethyl)acrylate, 2-carboxyethyl methacrylate, combinations thereof, and the like. Other functional monomers that may be used include, for example, acrylic acid and its derivatives.

The functional monomer having carboxylic acid functionality may also contain a small amount of metallic ions, such as sodium, potassium, and/or calcium, to achieve better emulsion polymerization results. The metallic ions may be present in an amount from about 0.001 to about 10 wt % of the functional monomer having carboxylic acid functionality, such as from about 0.5 to about 5 wt %.

Where present, the functional monomer may be added in amounts from about 0.01 to about 5 wt % of the toner, such as from about 0.05 to about 2 wt % of the toner.

Shell

A shell may be formed on the aggregated particles. Any latex noted above used to form the core latex may be used to form the shell latex. In some embodiments, a styrene-n-butyl acrylate copolymer is used to form the shell latex. The shell latex may have a glass transition temperature of from about 35° C. to about 75° C., such as from about 40° C. to about 70° C.

Where present, a shell latex may be applied by any method within the purview of those skilled in the art, including dipping, spraying, and the like. The shell latex may be applied until the desired final size of the toner particles is achieved, such as from about 3 to about 12 microns, such as from about 4 microns to about 9 microns. The shell latex may be prepared by in-situ seeded semi-continuous emulsion copolymerization of the latex and the shell latex can be added once aggregated particles have formed.

Where present, the shell latex may be present in an amount of from about 20 to about 40 wt % of the dry toner particle, such as from about 26 to about 36 wt %, or from about 27 to about 34 wt % of the dry toner particle.

Methods

Toners of the present disclosure may be prepared by combining a latex polymer, a wax, an optional colorant in the aggregation process followed by the coalescence process, washing and drying and than blending external surface additives. The latex polymer may be prepared by any method within the purview of those skilled in the art. One way the latex polymer may be prepared is by emulsion polymerization methods, including semi-continuous emulsion polymerization.

Emulsion aggregation procedures typically include the basic process steps of mixing together an emulsion containing a polymer or a resin, optionally one or more waxes, optionally one or more colorants, optionally one or more surfactants, an optional coagulant, and one or more additional optional additives to form a slurry; heating the slurry to form aggregated particles in the slurry; optionally adding the shell and freezing aggregation of the particles by adjusting the pH; and heating the aggregated particles in the slurry to coalesce the particles into toner particles; and then recovering, optionally washing, and optionally drying the obtained emulsion aggregation toner particles.

pH Adjustment Agent

A pH adjustment agent may be added to control the rate of the emulsion aggregation process and the coalescence process. The pH adjustment agent may be any acid or base that does not adversely affect the products being produced. Suitable bases include metal hydroxides, such as sodium hydroxide, potassium hydroxide, ammonium hydroxide, and combinations thereof. Suitable acids include nitric acid, sulfuric acid, hydrochloric acid, citric acid, acetic acid, and combinations thereof.

Surface Additive Package

A surface additive package may be applied to the toner particles. The additive package generally coats or adheres to external surfaces of the toner particles, rather than being incorporated into the bulk of the toner particles. The components of the additive package are selected to enable superior toner flow properties, high toner charge, charge stability, denser images, and lower drum contamination.

The surface additive package may comprise a first silica and a second silica, where the first silica is surface treated with hexamethyldisilazane (HMDS), and the second silica has an untreated surface, the second silica having a volume average diameter that is on the order of 10 to 20 times greater than the volume average diameter of the first silica. The HMDS silica may have a volume average diameter of from about 5 to about 50 nm, such as from about 10 to about 50 nm, or from about 20 to about 40 nm, or from about 5 to about 10 nm, or from about 8 to about 15 nm, or from about 7 to about 9 nm, such as 5 nm, 6 nm, 7 nm, 8 nm, 9 nm, 10 nm, 11 nm, 12 nm, 13 nm, 14 nm, 15 nm, 35 nm, or 40 nm. In some embodiments, 40 nanometer HMDS silica, is used. The second silica may be a sol-gel silica. The second silica may have a volume average diameter of from about 100 to about 180 nm, such as from about 100 to about 150 nm, or from about 140 to about 180 nm, or from about 120 to about 150 nm. In some embodiments, 140 nanometer sol-gel silica is used.

The surface additive package may further comprise a polydimethylsiloxane (PDMS) silica. The PDMS silica may have a volume average diameter of from about 5 to about 50 nm, such as from about 10 to about 50 nm, or from about 20 to about 40 nm, or from about 5 to about 10 nm, or from about 8 to about 15 nm, or from about 7 to about 9 nm, such as 5 nm, 6 nm, 7 nm, 8 nm, 9 nm, 10 nm, 11 nm, 12 nm, 13 nm, 14 nm, 15 nm, 35 nm, or 40 nm. In some embodiments, 40 nanometer PDMS silica is used.

The HMDS surface treated silica may be present in an amount of from about 0.05 to about 2 wt % of the particle, such as from about 0.25 to about 1.8 wt %, or from about 0.3 to about 1.4 wt %, or from about 0.50 to about 1.3 wt %. Also, the weight ratio of the HMDS surface treated silica to the sol-gel silica may be in a range of from about 1:0.3 to about 1.5:1, such as from about 1.0:0.5 to about 1:1. The sol-gel silica may be present in an amount of from about 0.10 to about 1.00 wt % of the particle, such as from about 0.30 to about 0.90 wt %, or from about 0.40 to about 0.80 wt %, or from about 0.45 to about 0.65 wt %. The PDMS silica may be present in an amount of from about 0.10 to about 3.00 wt % of the particle, such as from about 0.30 to about 2.75 wt %, or from about 0.40 to about 2.7 wt %, or from about 0.5 to about 2.55 wt %.

The external surface additive package may be present in an amount from about 2.5 to about 5 wt % by weight of the toner particle, such as from about 3 to about 4 wt % of the particle. The total additives package may be in the range of from about 2 to about 4 wt % of the toner. The total of the different silicas in the surface additive package may be about 1.5 to about 3.5 wt %, such as from about 2 to about 3.4%, or from about 2.3 to about 3.3 wt %.

Other Optional Additives

In addition to the surface additive package described above, further optional additives may be combined with the toner. These include any additive to enhance the properties of toner compositions. For example, the toner may include positive or negative charge control agents in an amount, for example, of from about 0.1 to about 10 wt % of the toner, such as from about 1 to about 3 wt %. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; metal salicylates combinations thereof, and the like.

Other included additives include an organic spacer, such as polymethylmethacrylate (PMMA). The organic spacer may have a volume average diameter of from about 300 to about 600 nm, such as from about 300 to about 400 nm, or from about 350 to about 450 nm, such as 300 nm, 350 nm, 400 nm, 450 nm, or 500 nm. In some embodiments, 400 nanometer PMMA organic spacer is used.

Other additives include surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives may each be present in an amount of from about 0.1 to about 10 wt % of the toner, such as from about 0.5 to about 7 wt %. Examples of such additives include, for example, those disclosed in U.S. Pat. Nos. 3,590,000, 3,720,617, 3,655,374, and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 wt % of the toner, such as from about 0.1 to about 2 wt % of the toner. These additives may be added during the aggregation or blended into the formed toner product.

Toner Properties

Emulsion aggregation processes provide greater control over the distribution of toner particle sizes and by limiting the amount of both fine and coarse toner particles in the toner. In some embodiments, the toner particles have a relatively narrow particle size distribution with a lower number ratio geometric standard deviation (GSDn) of about 1.15 to about 1.40, such as from about 1.15 to about 1.25, or from about 1.20 to about 1.35. The toner particles may also exhibit an upper geometric standard deviation by volume (GSDv) in the range of from about 1.15 to about 1.35, such as from about 1.15 to about 1.21, or from about 1.18 to about 1.30.

The toner particles may have a volume average diameter (also referred to as "volume average particle diameter" or "$D_{50v}$,") of from about 3 to about 25 μm, such as from about 4 to about 15 μm, or from about 5 to about 12 μm, or from about 6.5 to about 8 μm. $D_{50v}$, GSDv, and GSDn may be determined using a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

By optimizing the particle size of the particles, in some cases from about 6.5 to about 7.7 μm, toners of the present disclosure may be especially suited for bladeless cleaning systems, i.e., single component development (SCD) systems. With a proper sphericity, the toners of the present disclosure may assist in optimized machine performance.

The toner particles may have a circularity of about 0.920 to about 0.999, such as from about 0.940 to about 0.980, or from about 0.950 to about 0.998, or from about 0.970 to about 0.995, or from about 0.962 to about 0.980, from about greater than or equal to 0.982 to about 0.999, or from about greater than or equal to 0.965 to about 0.990. A circularity of 1.000 indicates a completely circular sphere. Circularity may be measured with, for example, a Sysmex FPIA 2100 or 3000 analyzer.

The toner particles may have a shape factor of from about 105 to about 170, such as from about 110 to about 160, SF1*a. Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The toner particles may have a surface area of from about 0.5 $m^2/g$ to about 1.4 $m^2/g$, such as from about 0.6 $m^2/g$ to about 1.2 $m^2/g$, or from about 0.7 $m^2/g$ to about 1.0 $m^2/g$. Surface area may be determined by the Brunauer, Emmett, and Teller (BET) method. BET surface area of a sphere can be calculated by the following equation:

$$\text{Surface Area}(m^2/g)=6/(\text{Particle Diameter}(um)*\text{Density}(g/cc)).$$

The toner particles may have a weight average molecular weight (Mw) in the range of from about 2,500 to about 65,000 daltons, a number average molecular weight (Mn) of from about 1,500 to about 28,000 daltons, and an MWD (a ratio of the Mw to Mn of the toner particles, a measure of the polydispersity, or width, of the polymer) of from about 1.2 to about 10. For cyan and yellow toners, the toner particles can exhibit an Mw of from about 2,500 to about 65,000 daltons, an Mn of from about 1,500 to about 28,000 daltons, and a MWD of from about 1.2 to about 10. For black and magenta, the toner particles can exhibit an Mw of from about 2,500 to about 60,000 daltons, an Mn of from about 1,500 to about 28,000 daltons, and an MWD of from about 1.2 to about 10.

The characteristics of the toner particles may be determined by any suitable technique and apparatus and are not limited to the instruments and techniques indicated herein above.

Further, the toners, if desired, can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder, which represents the highest peak of the Mw. In the present disclosure, the binder can have Mp values in the range of from about 5,000 to about 50,000 daltons, such as from about 7,500 to about 45,000 daltons. The toner particles prepared from the binder also exhibit a high molecular peak, for example, of from about 5,000 to about 43,000, such as from about 7,500 to about 40,500 daltons, indicating that the molecular peak is driven by the properties of the binder rather than another component such as the colorant.

Toners of the present disclosure have excellent properties including hot offset resistance, low minimum fix temperature, and high density. For example, the toners may possess low minimum fix temperatures, i.e., temperatures at which images produced with the toner may become fixed to a substrate, of from about 135° C. to about 220° C., such as from about 155° C. to about 220° C. The toners may have a fusing percentage of from about 50% to about 100%, or from about 60% to about 90%. The fusing percentage of an image may be evaluated in the following manner. Toner is fused from low to high temperatures depending upon initial setpoint. Toner adherence to paper is measured by tape removal of the areas of interest with subsequent density measurement. The density of the tested area is divided by the density of the area before removal then multiplied by 100 to obtain percent fused. The optical density is measured with a spectrometer (for example, a 938 Spectrodensitometer, manufactured by X-Rite). Then, the optical densities thus determined are used to calculate the fusing ratio according to the following Equation.

$$\text{Fusing (\%)} = \frac{\text{Area after removal}}{\text{Area before removal}} \times 100$$

Crease fix MFT is measured by folding images that have been fused over a wide range of fusing temperatures and then rolling a defined mass across the folded area, The print can also be folded using a commercially available folder such as the Dupla D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease fix MFT. The toner compositions may have a crease fix MFT of, for example, from about 115° C. to about 145° C., such as from about 120° C. to about 140° C., or from about 125° C. to about 135° C.

The toners may also possess excellent charging characteristics when exposed to extreme relative humidity (RH) conditions. The low-humidity zone may be about 12° C./15% RH, while the high humidity zone may be about 28° C./85% RH. Toners of the present disclosure may possess a parent toner charge per mass ratio (Q/M) of from about −2 μC/g to about −50 μC/g, such as from about −4 μC/g to about −35 μC/g, and a final toner charging after surface additive blending of from −8 μC/g to about −40 μC/g, such as from about −10 μC/g to about −25 μC/g.

The toners may exhibit a heat cohesion at 54° C. of, for example, from about 0% to about 60%, such as from about 5% to about 20%, or from about 0% to about 10%, or at about 5%. The toners may exhibit a heat cohesion at 55° C. of, for example, from about 0% to about 80%, such as from about 5% to about 20%, or from about 0% to about 60%, or about 8%. The toners may exhibit a heat cohesion at 56° C. of, for example, from about 0% to about 90%, such as from about 5% to about 30%, or from about 0% to about 70%, or about 20%.

The toners may exhibit a hot offset temperature of, for example, from about 200° C. to about 230° C., such as from about 200° C. to about 220° C., or from about 205° C. to about 215° C.

The toner compositions may have a flow, measured by Hosakawa Powder Flow Tester. Toners of the present disclosure may exhibit a flow of from about 25 to about 55%, or from about 30 to about 40%.

The toner composition may be measured for compressibility, which is partly a function of flow. Toners of the present disclosure may exhibit a compressibility of from about 8 to about 14%, or from about 10 to about 12% at 9.5-10.5 kPa.

The drum contamination after using the toner compositions may be measured by removing the drum and subsequently weighing. Toners of the present disclosure may exhibit a drum contamination from about 0 to about 20%, or from about 1 to about 8%.

The density of the toner compositions may be measured by densitometer. Toners of the present disclosure may exhibit a density of from about 1.2 to about 1.8, or from about 1.4 to about 1.6.

Imaging

Toners in accordance with the present disclosure may be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure may be selected for electrophotographic imaging and printing processes such as digital imaging systems and processes.

One benefit of the formulation disclosed herein that the reduction in contamination of the bias charge roll (BCR). These toners are particularly well-suited for use in printers with cleaning systems including a BCR and electrostatic roll for charging the photoreceptor. This means that the formulations are also particularly well-suited for use in small office printers.

The following Examples are intended to be illustrative only and are not intended to limit the scope of the present disclosure.

EXAMPLES

Toners were prepared using a 10 liter Henschel blender by blending EA toner particles prepared by the aggregation process with external additives. EA toner particles were prepared according to the formulation summarized in table 1 . . . . Water was added so that the reactor had a solids content of about 14%. The amount of secondary latex and wax was optimized to avoid issues in hot offset and minimum fusing. The target properties of the toner are a median volume of the dry particle of about 6.8-7.4 μm and a circularity of >0.980.

TABLE 1

| Toner Particle Formulation | |
|---|---|
| Raw Material | Parts |
| Core latex (styrene/butyl acrylate) | 11.8 |
| Shell latex (styrene/butyl acrylate) | 8.79 |
| Secondary latex (crosslinked styrene/butyl acrylate) | 3.52 |
| Regal 330 (carbon black pigment) | 2.77 |
| Pigment Blue 15:3 (cyan pigment) | 0.71 |
| Wax dispersion | 4.51 |
| Polyaluminum chloride (PAC) | 0.187 |

The toner formulation was found to be about 5-10% secondary latex, about 8-15% wax, 3-6% carbon black pigment, 0.5-3% cyan pigment using a latex resin having a particle size of about 180 to about 280 nm, at about 40% solids and about 25 to about 35% in the shell. The formulation is summarized below in Table 2.

TABLE 2

| Percentage Range of Dry Toner Particle | |
|---|---|
| Toner particle | 100 |
| Bulk Resin | 35-45 |
| Shell Resin | 25-35 |
| Secondary Latex | 5-10 |
| Regal 330Pigment | 3-6 |

TABLE 2-continued

| Percentage Range of Dry Toner Particle | |
|---|---|
| PB 15:3 Pigment | 1.00 |
| Wax | 8-15 |

Various additive packages were added to the general particle composition to create seven different exemplary toners. The composition of the additive packages are summarized in Table 3.

TABLE 3

| Additives in Examples | | | | |
|---|---|---|---|---|
| Toner | 40 nm PDMS Silica (Range wt/wt) | 140 nm Sol Gel Silica (Range wt/wt) | 40 nm HMDS Silica (Range wt/wt) | 400 nm organic spacer (Range wt/wt) |
| Example 1 | 0.45-0.65 | 0.45-0.65 | 0.95-1.35 | 0.4-0.7 |
| Example 2 | 2.0-3.0 | 0.05-0.25 | 0.45-0.65 | 0.4-0.7 |

Example 1 and 2 were prepared by Henschel blending of components for 5-15 minutes at 2500-3500 RPM.

The examples prepared by an emulsion aggregation (EA) process. Toner particles were formed through an EA process by combining a styrene/butylacrylate latex polymer with a low viscosity wax, carbon black, and cyan pigments in a ratio of 10.2:2:1 in a reaction vessel. Polyaluminum chloride was then added to the system and the mixture homogenized. Once homogenized, the mixture was heated to near the glass transition temperature (50-60° C.) of the polymer until the particle reached pre-shell size of 6.0-6.5 μm. Once the aggregate was at the appropriate size, the same polymer latex was added to create a shell of no less than 20% of the total latex addition. After the shell was added, the reaction vessel was held at temperature for a period of time and a base was added to freeze the particle size. After frozen, the temperature was raised to no less than 90° C., and the pH was adjusted to no higher than 4.5. The mixture then coalesced until the sphericity of the particle was 0.980 or greater. The batch was then cooled, pH was adjusted up to 8-9, washed, and dried. The dried particle was then taken and blended with an additive package to produce a toner. The additive package included 0.45-0.65 wt % medium PDMS silica, 0.45-0.65 wt % large sol gel silica, 0.95-1.35 wt % medium HMDS silica, and 0.4-0.7 wt % 400 nm PMMA organic spacer.

Fusing and Compressibility Testing

Toner compressibility was measured by a Freeman FT4 powder flow rheometer. Table 4 provides the results of compressibility tests for Examples 1 and 2.

Compressibility is a function of at least flow. Examples 1 and 2 all showed improved flow. As discussed above, flow is important in higher speed printing.

TABLE 4

| Compressibility Results | | | | | |
|---|---|---|---|---|---|
| | 2 kPa | 6 kPa | 8 kPa | 10 kPa | 14 kPa |
| Example 1 | 8 | 9.8 | 11.3 | 11.92 | 12.6 |
| Example 2 | 8.84 | 11.9 | 12.6 | 13.7 | 14 |

Fusing was also tested for Examples 1 and 2. Both toners showed excellent fix properties. Fix of about 80% was achieved at approximately 150° C., while about 100% fix was achieved at 165° C. This is significantly lower fix temperature compare with previous toners, which showed about 100% fix at 185° C.

Testing Conditions

The examples were next put through testing at two extreme printing conditions. First, cold and dry printing conditions; and second, warm and humid printing conditions. It is desirable that toners and developers be functional under a broad range of environmental conditions to enable good image quality from a printer. Thus, it is desirable for toners and developers to function at low humidity and low temperature, for example at 50° F. and 20% relative humidity and high humidity and temperature, for example at 80° F. and 80-85% relative humidity.

Density

The image density was tested by Xrite densitometer. After printing, the results were measured using a handheld machine to calculate the image density of a controlled area of the printed page.

The image density was unexpectedly high for Examples 1 and 1 Higher density results in a darker picture on the printed page. Examples 1 and 2 achieved a high image density while using less toner.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising:
toner particles comprising:
a resin;
an optional wax; and
an optional colorant; and
a surface additive at least partially coating toner particle surfaces, the surface additive comprising a mixture of:
a hexamethyldisilazane (HMDS) surface treated silica,
a sol-gel silica that is not surface treated,
a polydimethylsiloxane (PDMS) surface treated silica, and
an organic spacer having an average particle diameter of from 300 to 600 nm.

2. The composition of claim 1, wherein the HMDS surface treated silica has an average particle diameter of from about 5 to about 50 nm, the sol-gel silica has an average particle diameter of from about 100 to about 150 nm, and the PDMS silica has an average particle diameter of from about 5 to about 50 nm.

3. The composition of claim 1, wherein a weight ratio of the HMDS surface treated silica to the sol-gel silica is in a range of from about 1:0.3 to about 2:1.

4. The composition of claim 1, wherein a weight ratio of the HMDS surface treated silica to the sol-gel silica to the PDMS silica is in a range of from about 1:0.5:0.5 to about 5:1:1.

5. The composition of claim 1, wherein HMDS surface treated silica and sol-gel silica are present in the mixture in an amount of from about 0.5 to about 1.2 wt % based on a total weight of the toner composition.

6. The composition of claim 1, wherein HMDS surface treated silica, sol-gel silica, and PDMS silica are present in the mixture in an amount of from about 2.2 to about 3.8 wt % based on a total weight of the toner composition.

7. The composition of claim 1, wherein the toner particles comprise a modified paraffin wax having branched carbons in combination with linear carbons.

8. The composition of claim 1, wherein the toner particles comprise:
a core and a shell,
the core comprising a resin including a first non-crosslinked polymer in combination with a crosslinked polymer, and
the shell comprising a second non-crosslinked polymer present in an amount of from about 20 to about 40 wt % of the toner;
a modified paraffin wax possessing branched carbons in combination with linear carbons; and
an optional colorant.

9. The composition of claim 8, wherein the first non-crosslinked polymer, the second non-crosslinked polymer, or both, comprise at least one monomer selected from the group consisting of styrenes, acrylates, methacrylates, butadienes, isoprenes, acrylic acids, methacrylic acids, acrylonitriles, and combinations thereof.

10. The composition of claim 8, wherein the crosslinked polymer is present in an amount of from about 6 to about 14 wt % of the toner.

11. The composition of claim 1, wherein the toner particles have a circularity of from about 0.920 to about 0.999.

12. The composition of claim 1, wherein the toner particles have a volume average diameter of from about 3 to about 25 μm.

13. The composition of claim 1, wherein the mixture is present in the toner composition in an amount from about 2.5 to about 4.0 wt % based on a total weight of the toner composition.

14. The composition of claim 1, wherein:
the HMDS surface treated silica has an average particle diameter of from about 20 to about 40 nm, and is present in an amount of 0.95 to 1.35 wt % based on a total weight of the toner composition;
the sol-gel silica has an average particle diameter of from about 100 to about 150 nm, and is present in an amount of 0.45 to 0.65 wt % based on a total weight of the toner composition;
the PDMS surface treated silica has an average particle diameter of from about 20 to about 40 nm, and is present in an amount of 0.45 to 0.65 wt % based on a total weight of the toner composition; and
the organic spacer that has an average particle diameter of 300 to 600 nm is present in an amount of 0.4 to 0.7 wt % based on a total weight of the toner composition.

15. The composition of claim 14, wherein:
the MHDS surface treated silica has an average particle diameter of about 40 nm;
the sol-gel silica has an average particle diameter of about 140 nm;
the PDMS silica has an average particle diameter of about 40 nm; and
the organic spacer has an average particle diameter of about 400 nm.

16. The composition according to claim 1, wherein:
the HMDS surface treated silica has an average particle diameter of from about 20 to about 40 nm, and is present in an amount of 0.45 to 0.65 wt % based on a total weight of the toner composition;
the sol-gel silica has an average particle diameter of from about 100 to about 150 nm, and is present in an amount of 0.05 to 0.25 wt % based on a total weight of the toner composition;

the PDMS surface treated silica has an average particle diameter of from about 20 to about 40 nm, and is present in an amount of 2.0 to 3.0 wt % based on a total weight of the toner composition; and the organic spacer that has an average particle diameter of from 300 to 600 nm is present in an amount of 0.4 to 0.7 wt % based on a total weight of the toner composition.

17. The composition of claim 1, wherein the organic spacer is a polymethylmethacrylate (PMMA).

18. A toner composition comprising:

a surface additive at least partially coating toner particle surfaces, the surface additive comprising a mixture of:

a hexamethyldisilazane (HMDS) surface treated silica that has an average particle diameter of from about 20 to about 40 nm, and that is present in an amount of 0.95 to 1.35 wt % based on a total weight of the toner composition;

a sol-gel silica that is not surface treated that has an average particle diameter of from about 100 to about 150 nm, and that is present in an amount of 0.45 to 0.65 wt % based on a total weight of the toner composition;

a polydimethylsiloxane (PDMS) surface treated silica that has an average particle diameter of from about 20 to about 40 nm, and that is present in an amount of 0.45 to 0.65 wt % based on a total weight of the toner composition; and an organic spacer that has an average particle diameter of from 300 to 600, and that is present in an amount of 0.4 to 0.7 wt % based on a total weight of the toner composition.

19. The composition of claim 18, wherein:

the HMDS surface treated silica has an average particle diameter of about 40 nm;

the sol-gel silica has an average particle diameter of about 140 nm;

the PDMS surface treated silica has an average particle diameter of about 40 nm; and the organic spacer has an average particle diameter of about 400 nm.

20. A method of making a toner composition, the method comprising:

forming a slurry by mixing together:

an emulsion containing a resin;

optionally a wax;

optionally a colorant;

optionally a surfactant;

optionally a coagulant; and one or more additional optional additives;

heating the slurry to form aggregated particles in the slurry;

freezing aggregation of the particles by adjusting the pH;

heating the aggregated particles in the slurry to coalesce the particles into toner particles;

washing and drying the toner particles; and coating the toner particles with a surface additive comprising a mixture of:

a hexamethyldisilazane (HMDS) surface treated silica, a sol-gel silica that is not surface treated, a polydimethylsiloxane (PDMS) surface treated silica, and an organic spacer having an average particle diameter of from 300 to 600 nm.

21. The method of claim 20, wherein:

the HMDS surface treated silica has an average particle diameter of from about 5 to about 50 nm, and the sol-gel silica has an average particle diameter of from about 100 to about 150 nm.

22. The method of claim 20, wherein a weight ratio of the HMDS surface treated silica to the sol-gel silica is in a range of from about 1:0.3 to about 2:1.

23. The method of claim 20, wherein a weight ratio of the HMDS surface treated silica to the sol-gel silica to the PDMS silica is in a range of from about 1:0.5:0.5 to about 1.0:0.3:5.0.

24. The method of claim 23, wherein HMDS surface treated silica and sol-gel silica are present in the mixture in an amount of from about 1.6 to about 2.9 wt % based on a total weight of the toner composition.

25. The method of claim 24, wherein HMDS surface treated silica, sol-gel silica, and PDMS silica are present in the mixture in an amount of from about 2.20 to about 3.3 wt % based on a total weight of the toner composition.

26. The method of claim 20, wherein the mixture of HMDS surface treated silica, sol-gel silica, PDMS silica, and organic spacer is present in the toner composition in an amount of from about 2.7 wt % to about 3.8 wt % based on a total weight of the toner composition.

* * * * *